US007065178B2

(12) United States Patent
Rother

(10) Patent No.: US 7,065,178 B2
(45) Date of Patent: Jun. 20, 2006

(54) ROTATING ANODE X-RAY TUBE

(75) Inventor: Peter Rother, deceased, late of Baiersdorf (DE); by Jutta Rother, legal representative, Baiersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/837,187

(22) Filed: Apr. 30, 2004

(65) Prior Publication Data

US 2005/0002492 A1 Jan. 6, 2005

(30) Foreign Application Priority Data

Apr. 30, 2003 (DE) ..... 103 19 549

(51) Int. Cl.
*H01J 35/16* (2006.01)

(52) U.S. Cl. ..... 378/125; 378/121; 378/144

(58) Field of Classification Search ..... 378/119, 378/121, 122, 125, 127, 128, 129, 136, 141, 378/142, 143, 144
See application file for complete search history.

(56) References Cited

U.S. PATENT DOCUMENTS

| | | | | |
|---|---|---|---|---|
| 4,053,802 | A * | 10/1977 | Hartl | 378/121 |
| 4,644,577 | A * | 2/1987 | Gerkema et al. | 378/132 |
| 5,345,492 | A * | 9/1994 | Weaver et al. | 378/125 |
| 5,802,140 | A * | 9/1998 | Virshup et al. | 378/136 |
| 5,930,332 | A * | 7/1999 | Eggleston et al. | 378/144 |
| 6,529,579 | B1 * | 3/2003 | Richardson | 378/127 |

FOREIGN PATENT DOCUMENTS

| | | | |
|---|---|---|---|
| DE | 34 29 799 | | 2/1986 |
| DE | 19612220 | A1 * | 4/1997 |
| JP | 01109647 | A * | 4/1989 |
| WO | WO 03/083891 | | 10/2003 |

* cited by examiner

*Primary Examiner*—Edward J. Glick
*Assistant Examiner*—Chih-Cheng Glen Kao
(74) *Attorney, Agent, or Firm*—Schiff Hardin LLP

(57) ABSTRACT

A rotating anode x-ray tube has a rotating anode contained in a vacuum-sealed housing with a compartment for a cathode projecting from a cover of the housing opposite the rotating anode. To improve the durability, a transition part connecting the compartment with the cover has high-temperature stability that is greater than that of the cover or of the compartment.

13 Claims, 2 Drawing Sheets

ROTATING ANODE X-RAY TUBE

BACKGROUND OF THE INVENTION

1. Field of the Invention

The present invention relates to a rotating anode x-ray tube of the type having a housing, in which a rotating anode is disposed, and having a cover with a compartment projecting therefrom in which a cathode is disposed.

2. Description of the Prior Art and Related Subject Matter

Rotating anode x-ray tubes are known, for example from German OS 34 29 799. A rotating anode is accommodated in a vacuum-sealed housing. Electrons are accelerated onto the rotating anode from a radially disposed cathode. The x-ray radiation thereby formed exits from the housing.

A rotating anode x-ray tube according of this type is commercially available from Siemens AG under the product designation "Dura 502". A cover of the housing opposite the rotating anode has a compartment or chamber to accept the cathode. Given an operation over long duration of such a rotating anode x-ray tube under high load, it sometimes leads to leakages in the transfer region between cover and the compartment.

From WO 03/083391, a rotating anode x-ray tube with a rotating anode incorporated into a vacuum-sealed housing is known in which a compartment for acceptance of a cathode is provided on a cover of the housing opposite the rotating anode. A transition part made of copper and connecting the compartment with the cover is provided which is connected with a heat exchanger to dissipate heat from the transition part.

SUMMARY OF THE INVENTION

An object of present invention is to provide a rotating anode x-ray tube that avoids the disadvantages of the prior art. In particular, a rotating anode x-ray tube with improved lifespan should be achieved.

This object is achieved in accordance with the invention by a rotating anode x-ray tube having a transition part connecting the cathode compartment with the cover that formed of a material having a high-temperature stability that is greater than the high-temperature stability of the cover or of the compartment. The formation of leakages, even given long operating lives and given operation at high capacities thus is prevented in a relatively simple and cost-effective manner.

The term "high-temperature stability", as used herein means the selected material in particular exhibits an improved behavior under long-period stressing. For explanation, reference is made to Illschner B., "Werkstoffwissenschaften, Eigenschaften, Vorgänge, Technologien", 1982, pages 117 through 121. The compartment or the cover are typically produced from stainless steel, in particular from an austenitic steel, The material is appropriately formed from an alloy that is composed by weight of at least 70% molybdenum, tungsten or tantalum. Particularly preferred are alloys that are substantially composed of molybdenum or tantalum. Metals formed from such alloys can be economically shaped by drawing, stamping or forging. The inventive transition part can be produced without great effort from such alloys.

According to a further embodiment, the material can be produced from a ceramic, preferably from aluminum oxide or magnesium oxide.

The transition part can be fashioned as a neck connecting the cover with the compartment. A joining area connecting the transition part with the cover is appropriately located outside of a diameter of the compartment or the neck. Irradiation of the joining area with secondary electrons is thereby prevented. Such irradiation could cause unwanted damages in the joining area. In a further embodiment, the neck at each of its ends has a curvature (pointing radially outwards) or a collar. Such a transition part fashioned as a neck is appropriately rotationally symmetric. This cases the production and the joining.

The transition part can be connected with the cover and/or the well by means of a connection produced by friction welding. It is also possible to connect the transition part with the cover and/or the compartment by means of a high-temperature solder. The high-temperature solder has a melting point of at least approximately 1000° C., preferably at least 1250° C. The solder can be palladium.

DESCRIPTION OF THE PREFERRED EMBODIMENTS

Figure 1:
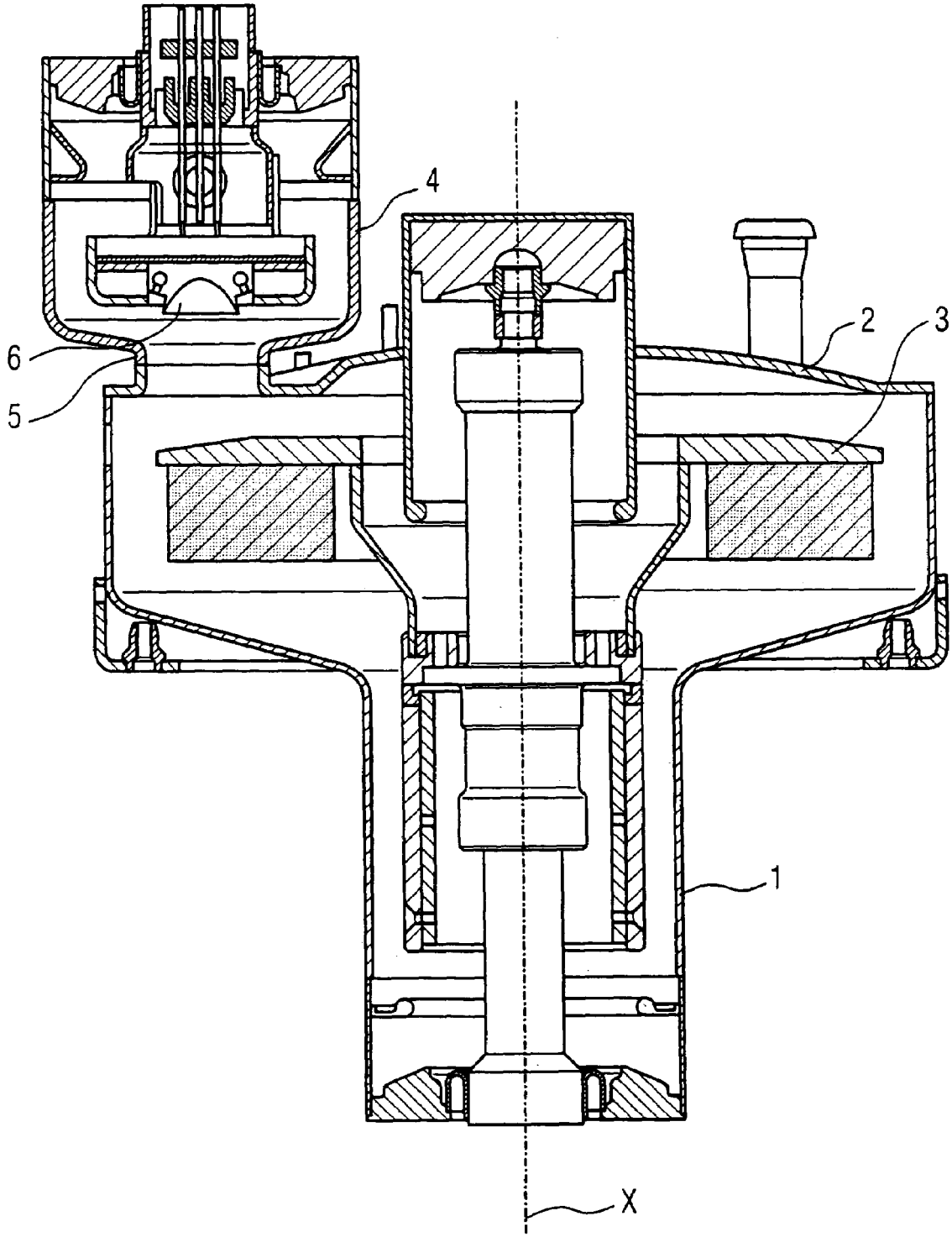
FIG 1 (PRIOR ART)
FIG. 1 is a schematic cross-section of a rotating anode x-ray tube according to the prior art.

A conventional rotating anode x-ray tube is schematically shown in FIG. 1 in cross-section, A housing implemented vacuum-sealed exhibits a housing bell 1 that is sealed with the deck 2. A rotating anode contained in the housing and rotatable around an axis X is designated with the reference character 3. A cathode compartment 4 that is attached to the cover 2 via a neck 5 projects from the cover 2 of the housing. A cathode housed in the cathode 4 is designated with the reference character 6.

Figure 2:
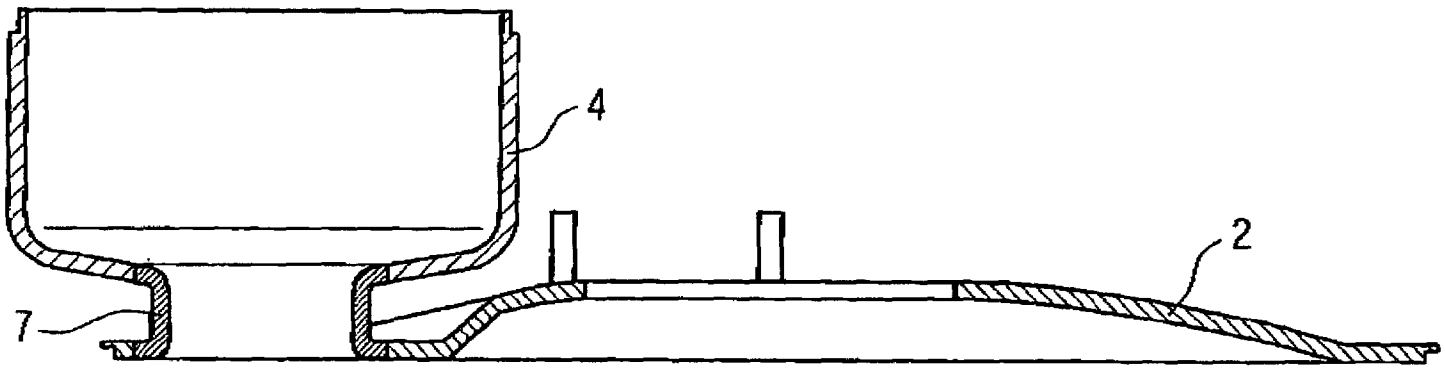
FIG. 2 is a cross-section of a cover with cathode compartment according to the invention.
Figure 3:
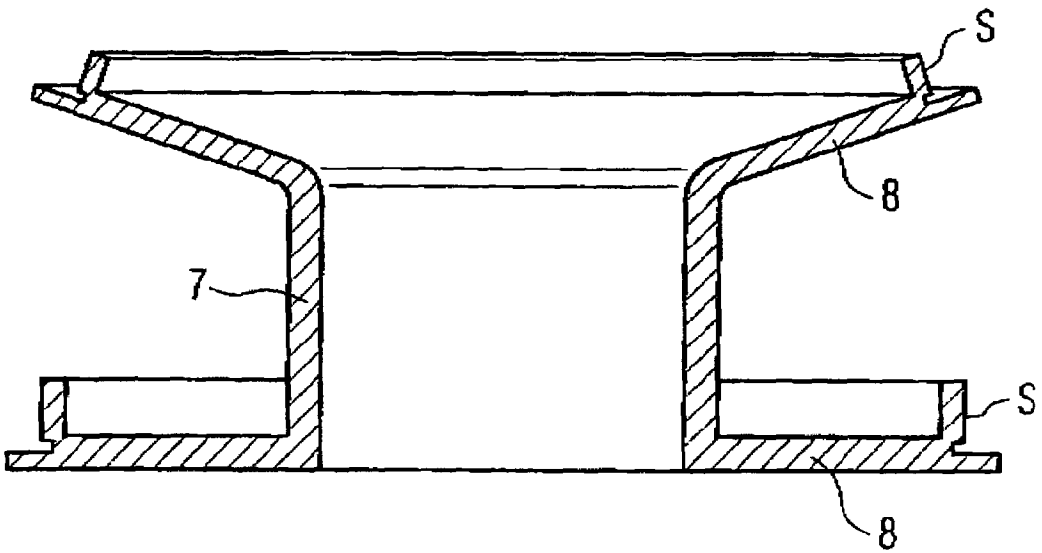
FIG. 3 is a cross-section of a transition part according to the invention.

FIG. 2 shows a cross-section of a cover 2 with a cathode compartment 4 of an inventive rotating anode x-ray tube. The neck 5 is implemented as a particular transition part 7. The transition part 7 is formed of a high-temperature material. The high-temperature stability of the material is greater than that of the material used to produce the cover 2 and/or the cathode well 4, in that it is typically austenitic steel. The transition part 7 is appropriately produced from an alloy that is substantially composed of molybdenum. The transition part 7 is shown again in FIG. 3 in enlarged representation. The transition part 7 at both ends has curvatures 8 pointing radially outwards. The end of each curvature 8 can be provided with a step S to ease the joining with the cover 2 and with the cathode compartment 4.

The transition part 7 shown as an example here naturally can exhibit a different geometry. The transition part 7 is appropriately attached to the cover 2 and/or the cathode compartment 4 by means of a high-temperature solder. In particular palladium-containing solders with a melting point of 1100 to 1250° C. have proven to be suitable. It is also possible to connect the transition part with the cover 2 and/or the cathode compartment 4 by means of friction welding.

Although modifications and changes may be suggested by those skilled in the art, it is the intention of the inventor to embody within the patent warranted hereon all changes and modifications as reasonably and properly come within the scope of his contribution to the art.

We claim:

1. A rotating anode x-ray tube comprising:

a vacuum-sealed housing having a housing body, a cover closing said housing body, and a compartment connected to said cover by a transition part, wherein said housing body, said cover, said compartment, and said transition part are separate parts connected together to form said vacuum-sealed housing;

said cover being composed of cover material having a high-temperature stability and said compartment being composed of compartment material having a high-temperature stability, and said transition part consisting of transition part material having a high-temperature stability greater than the high-temperature stability of said cover material and the high-temperature stability of said compartment material;

an anode rotatably mounted in said housing body; and a cathode stationarily mounted in said compartment.

2. A rotating anode x-ray tube as claimed in claim 1 wherein said transition part material has a heat conductivity greater than 16 WmK.

3. A rotating anode x-ray tube as claimed in claim 1 wherein said transition part material is an alloy comprised of at least 70% by weight of an element selected from the group consisting of molybdenum, tungsten, and tantalum.

4. A rotating anode x-ray tube as claimed in claim 1 wherein said transition part material is a ceramic.

5. A rotating anode x-ray tube as claimed in claim 4 wherein said ceramic is selected from the group consisting of aluminum oxide and magnesium oxide.

6. A rotating anode x-ray tube as claimed in claim 1 wherein said transition part forms a neck connecting said cover with said compartment.

7. A rotating anode x-ray tube as claimed in claim 6 wherein said neck has a diameter, and wherein said neck is connected to said cover at a joint region disposed beyond said diameter of said neck.

8. A rotating anode x-ray tube as claimed in claim 6 wherein said neck has opposite ends, and wherein each of said ends has a curvature extending radially outwardly.

9. A rotating anode x-ray tube as claimed in claim 1 wherein said transition part forms a first joint with said cover and a second joint with said compartment, and wherein at least one of said first and second joints is a friction-welded joint.

10. A rotating anode x-ray tube as claimed in claim 1 wherein said transition part is connected with said cover at a first joint and is connected with said compartment at a second joint, and wherein at least one of said first and second joints is a soldered joint formed by a high-temperature solder.

11. A rotating anode x-ray tube as claimed in claim 10 wherein said high-temperature solder has a melting point of at least 1000° C.

12. A rotating anode x-ray tube as claimed in claim 11 wherein said high-temperature solder has a melting point of at least 1250° C.

13. A rotating anode x-ray tube as claimed in claim 10 wherein said high-temperature solder comprises palladium.

* * * * *